US005601383A

United States Patent [19]

Zanin

[11] Patent Number: 5,601,383

[45] Date of Patent: Feb. 11, 1997

[54] EXCAVATION METHOD AND APPARATUS FOR ACCESSING UNDERGROUND PIPES OF PIPELINES FOR GAS, OIL, AND THE LIKE FOR MAINTENANCE AND/OR RESTORATION

[75] Inventor: Pierluigi Zanin, Padua, Italy

[73] Assignee: Goriziane S.p.A., Via Aquileia, Italy

[21] Appl. No.: 416,553

[22] Filed: Apr. 4, 1995

[30] Foreign Application Priority Data

Apr. 14, 1994 [IT] Italy ..... TO94A0288

[51] Int. Cl.[6] ..... F16L 1/00

[52] U.S. Cl. ..... 405/154; 405/173; 405/161; 37/364

[58] Field of Search ..... 405/159–164, 405/154, 174–183; 37/352–366

[56] References Cited

U.S. PATENT DOCUMENTS

| | | | |
|---|---|---|---|
| 3,238,734 | 3/1966 | Rhodes | 405/159 |
| 3,429,132 | 2/1969 | Martin | 405/161 |
| 3,857,250 | 12/1974 | Di Tella et al. | 405/160 |
| 4,395,158 | 7/1983 | Brooks | 405/161 |
| 4,409,747 | 10/1983 | Kaldenbach | 37/364 X |
| 4,643,613 | 2/1987 | Durner | 405/164 X |

FOREIGN PATENT DOCUMENTS

| | | | |
|---|---|---|---|
| 1348487 | 3/1974 | United Kingdom | 405/163 |

*Primary Examiner*—Dennis L. Taylor
*Attorney, Agent, or Firm*—Guido Modiano; Albert Josif

[57] ABSTRACT

A method consisting in forming a preliminary excavation along the pipe and in then digging, starting from the bottom of the preliminary excavation, two lateral trenches that are adjacent to the sides of the pipe, converge downwardly, and go deeper than the level set for the final excavation bed that lies below the pipe, so as to form respective lateral collection channels; and in removing, by cutting, the wall that separates the trenches in the region below the pipe, dumping the corresponding residual material into the lateral collection channels. The invention also relates to an apparatus, of the integral type or composed of dedicated units, for digging the lateral trenches and/or for cutting away the wall that lies below the pipe.

13 Claims, 5 Drawing Sheets

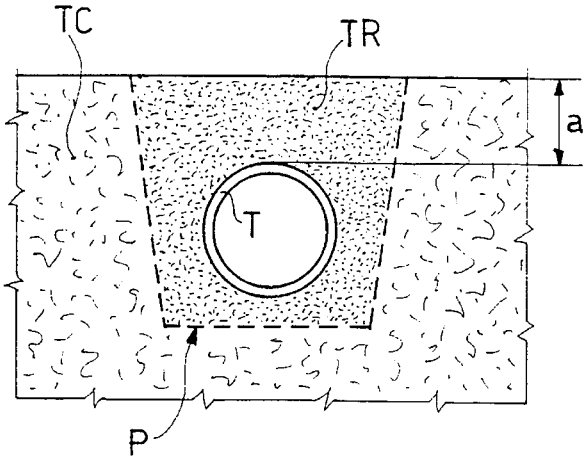
FIG.1
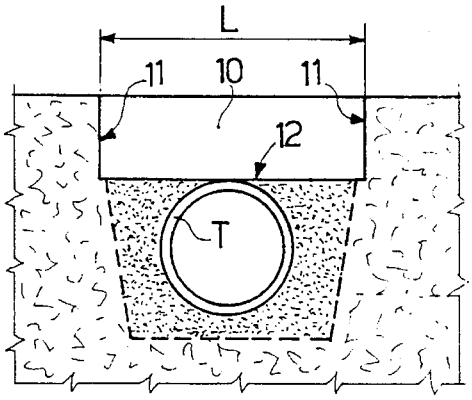
FIG.1a
FIG.1b
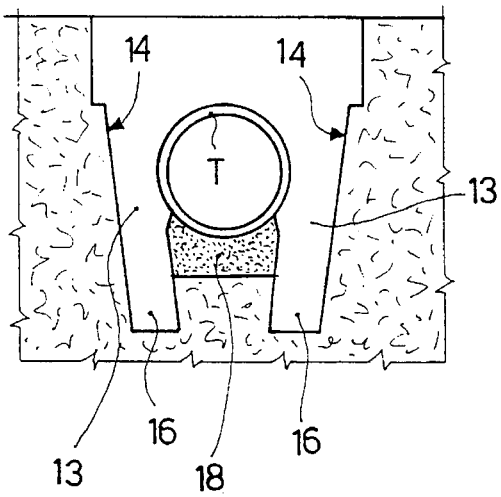
FIG.1c
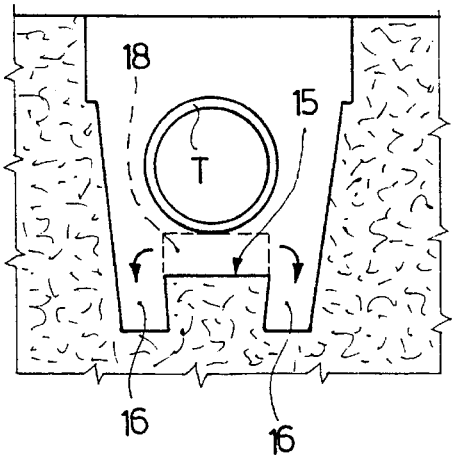

EXCAVATION METHOD AND APPARATUS FOR ACCESSING UNDERGROUND PIPES OF PIPELINES FOR GAS, OIL, AND THE LIKE FOR MAINTENANCE AND/OR RESTORATION

BACKGROUND OF THE INVENTION

The present invention relates to an excavation method and apparatus for accessing underground pipes of pipelines for gas, oil, and the like, generally defined as pipelines, for maintenance and/or restoration and/or repair.

It is known that underground pipes of pipelines for oil, gas, and the like are subjected, in the course of time, to various maintenance operations and particularly to the total or partial restoration of the outer protective sheathing of the pipes.

Such maintenance operations are generally performed without interrupting fluid delivery and require the pipe to be exposed completely by removing the soil even in the region below the pipe, in order to allow wrapping and the like or, in any case, the regeneration of the sheathing along the entire circumference of said pipe.

Currently there are no valid methods or devices capable of performing excavations of this type in a mechanized and economically advantageous manner, removing the soil even in the region below the pipe, and conventional bucket excavators are simply used to perform an excavation that exposes the upper and side regions of said pipe, whereas the material below the pipe is removed manually by employing teams of workers equipped with conventional tools.

Obviously these excavation methods are excessively onerous and dangerous, since the use of bucket excavators requires extreme caution and can easily damage the pipe, with possible disastrous consequences. Furthermore, using manual tools to remove the soil below the pipe exposes workers to considerable risk of injury, both because landslips may occur in the excavations formed to the side of the pipe, where the workers must work, and because the pipe may give way.

SUMMARY OF THE INVENTION

A principal aim of the present invention is to eliminate these and other drawbacks, and within the scope of this general aim, in view of the tens of thousands of kilometers of pipeline which now require reconditioning and restoration and/or checking, the invention has the important object of providing an excavation method and apparatus that are capable of quickly exposing said pipes in a fully mechanized manner and in maximum safety, performing an excavation that exposes the entire circumference of the pipes and leaves a gap below said pipes that is large enough to allow wrapping and similar operations.

Another important object of the present invention is to provide a method and an apparatus that are capable of exposing preset lengths of the pipe and of supporting the pipe by using supports constituted by walls that are formed by non-excavated portions below the pipe and are appropriately spaced according to the diameter of said pipe.

A further important object of the invention is to provide an excavation method and apparatus that facilitate subsequent operations for burying the pipe after restoration or maintenance.

According to the present invention, this aim, these important objects, and others are achieved with an excavation method and apparatus having the specific characteristics stated in the appended claims.

Substantially, the invention is based on the concept of performing, along the pipe, a preliminary excavation that is delimited by vertical walls and by a flat bottom the level of which is substantially tangent to the pipe at its vertical diameter.

The width of said preliminary excavation is chosen so as to be approximately equal to three times the diameter of said pipe. Starting from the bottom of the preliminary excavation, two inclined converging lateral trenches are formed adjacent to the pipe. Said lateral trenches go deeper than the level set for the final excavation bed below the pipe, so as to form two channels for collecting the residual material that is removed from the region below the pipe by cutting away the wall that separates said trenches.

The apparatus for performing the method according to the invention has at least one self-propelled tracked machine which is capable of moving on the bottom of the preliminary excavation and comprises two lateral trenchers of a per se known type, each of which is composed of a chain or belt that is guided by end sprockets and provided with excavation blades and with a double-helix cylindrical rotating cutter that is supported at the rotatable end of a supporting boom that is lowered into one of the two lateral trenches. By virtue of the fact that the end of the boom is rotatable, the rotating cutter lowered into the trench is turned from an inactive position, in which the axis of said rotating cutter is parallel to the sides of the trench, into an active position, in which said axis lies at right angles to the axis of the pipe and said rotating cutter is substantially tangent to said pipe. The rotating cutter is driven by a hydraulic motor and by turning removes the wall between the two trenches; by virtue of its double helix, said rotating cutter discharges the residual material into said lateral channels provided on the bottom of the trenches, filling them up to the level of the final excavation bed below the pipe. The gap of the excavation below the pipe is substantially equal in height to the diameter of the rotating cutter. As an alternative, the supporting boom and the corresponding rotating cutter located at its end can be separated from the first self-propelled machine provided with the trencher units and can be carried by a second self-propelled tracked machine, advantageously a tractor, which also moves along the bottom of the preliminary excavation or laterally thereto and follows the first machine.

BRIEF DESCRIPTION OF THE DRAWINGS

Further characteristics and advantages of the method and apparatus according to the present invention will become apparent from the following detailed description and with reference to the accompanying drawings, given by way of non-limitative example, wherein:

FIGS. 1, 1*a*, 1*b*, and 1*c* are schematic sectional views of the various steps of the excavation method according to the invention;

DESCRIPTION OF THE PREFERRED EMBODIMENTS

Figure 2:
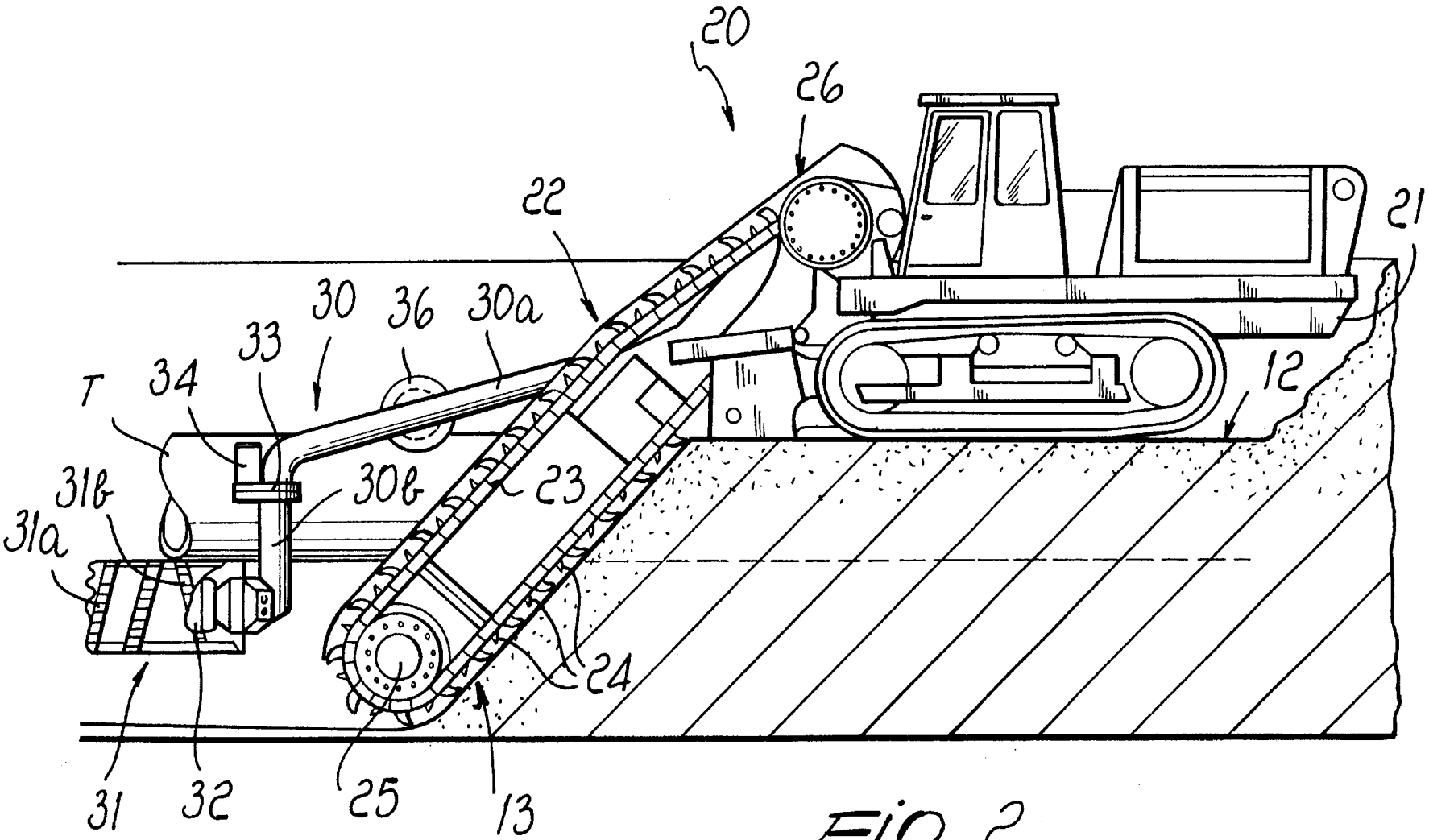
FIG. 2 is a partially sectional elevation view of an integrated apparatus for performing the excavation method of FIGS. 1*a* to 1*c*, the apparatus being shown with its rotating cutter in the inactive position.

With reference to FIGS. 1 to 1*c*, the letter T designates the pipe to be exposed, the letter P designates the profile of the original excavation performed to lay the pipe T, the letters TR designate the filling soil for covering the pipe after laying, the letter "a" is the standard covering depth, typically 1.5 meters, and the letters TC designate the compact soil that surrounds the profile P of the original excavation.

The excavation method according to the present invention, which is adapted to expose the pipe T for reconditioning and/or restoration and/or repair, includes a first step, shown in FIG. 1*a*, that consists in performing a preliminary excavation 10 which is delimited by vertical sides 11 and by a flat bottom 12 the depth of which is substantially equal to the covering depth "a" so that the surface of said bottom is tangent to the pipe T at its vertical diameter. The preliminary excavation 10 can be performed with conventional means, such as laterally-unloading power loaders, bucket excavators, and the like, but is preferably produced by using so-called trenchers of the wide-track type; the width L of said preliminary excavation is two to four times the diameter of the pipe T, typically approximately three times the diameter of the pipe.

The second excavation step is performed starting from the bottom 12 of the preliminary excavation; said step is shown in FIG. 1*b* and consists in excavating two trenches 13 that are arranged laterally to the pipe T, are inclined, and converge downwards. The inner sides 14 of said trenches are adjacent to the pipe T (see also FIG. 4) and go deeper than the level set for the final excavation bed 15 below the pipe T, so as to form two lateral channels 16 of adequate capacity.

A wall 18 that separates the trenches 13 is formed in the region below the pipe T between the bed 15 and the pipe T. In the subsequent and final step of the excavation, shown in FIG. 1*c*, the wall 18 is removed by cutting, as will become more apparent hereinafter, and the residual material is dumped into the channels 16, which are filled up to the level of the final excavation bed 15.

The depth and width of the channels 16, and therefore their capacity, are of course chosen so as to receive the residual material of the wall 18 without filling above said bed 15. Wall portions 18 are left in place at preset distances and act as supports for the pipe T; said wall portions accordingly have a proportionate axial length, which is typically between 1 and 2 meters.

Figure 4:
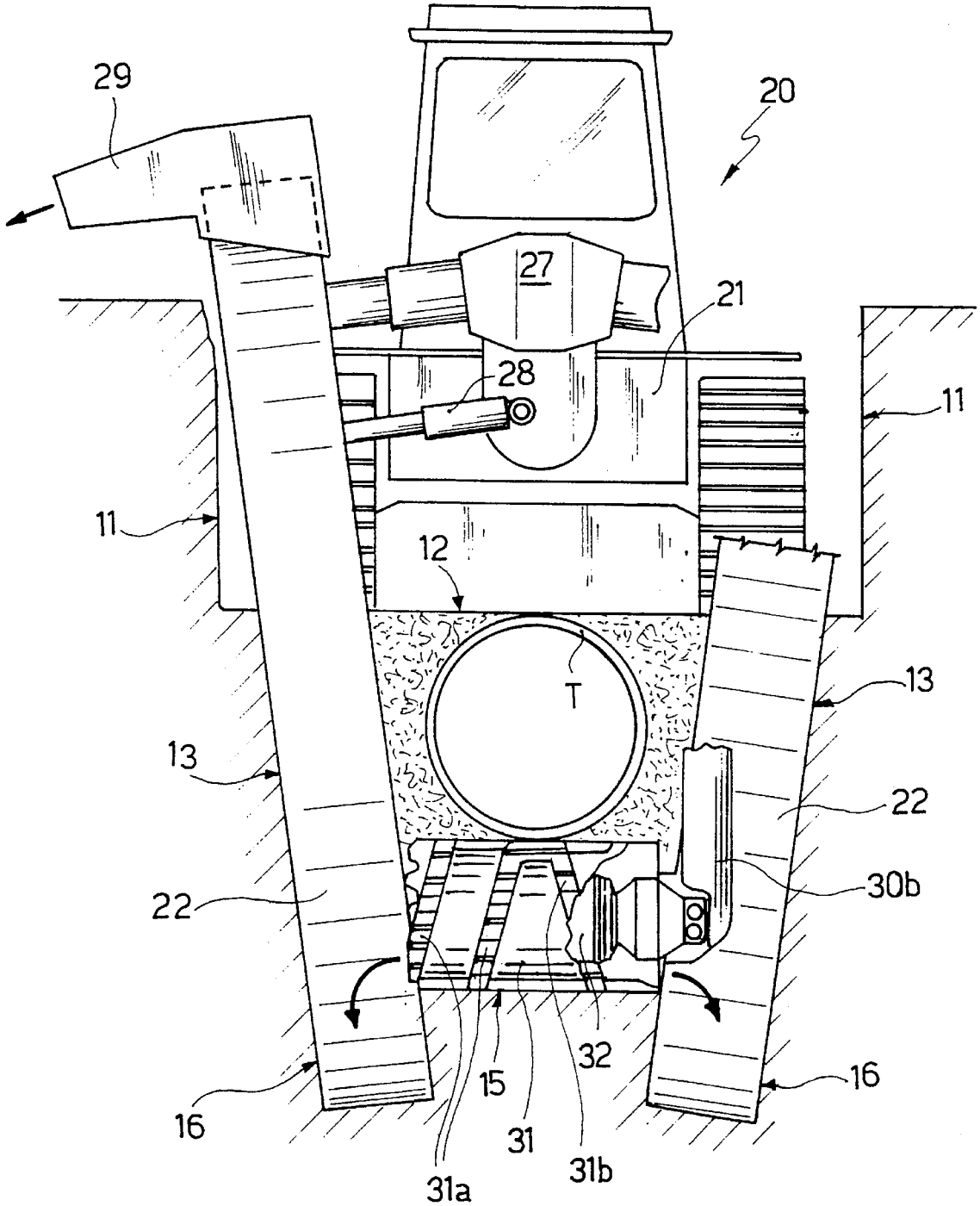
FIG. 4 is an enlarged-scale sectional view, taken along the plane IV—IV of FIG. 3.

FIG. 2 illustrates an apparatus for performing the excavation method of FIGS. 1*a*, 1*b*, and 1*c*. Said apparatus, generally designated by the reference numeral 20, is of the integral type and substantially comprises a self-propelled tracked unit 21 adapted to move along the bottom 12 of the preliminary excavation 10 along the axis of the pipe to be exposed. Two trencher units 22 are associated with the unit 21, and each one is formed by a belt 23 that is provided with excavation blades 24 and guided by end sprockets 25–26, one of which is driven by a hydraulic motor 27 (FIG. 4). The trenchers 22, which can be orientated in the vertical plane by virtue of corresponding hydraulic jacks 28 (FIG. 4), dig the two lateral trenches 13 in the above-described manner and use orientated outlets 29 to deposit the residual soil along the sides of the preliminary excavation 10 or, if required, on removal conveyors that are located to the sides of said preliminary excavation and not shown in the figure.

A cylindrical rotating cutter 31 with a horizontal axis and a double helix, respectively a left-hand helix 31*a* and a right-hand helix 31*b*, is also associated with the unit 21 and is supported by a boom 30 located to the rear of said machine. The rotating cutter 31 is turned by a hydraulic motor 32 that is coaxial to said rotating cutter and is contained inside it. The boom 30 runs along one side of the machine 21 and enters one of the trenches 13 with its end portion. Said boom has a fixed upper portion 30*a*, which is preferably provided with supporting rollers 36 made of elastomeric material that roll on the upper part of the pipe T; said rollers have a conical profile in order to retain the boom 30 transversely. A lower rotatable vertical portion 30*b* is articulated to the portion 30*a* of the boom and supports the motor 32; said portion 30*b* is connected to the fixed portion by means of a toothed swivel ring 33, or the like, and is controlled by a driving element, for example a gear motor 34, which is provided with a sprocket that cooperates with the teeth of the swivel ring and is capable of making the rotating cutter 31 perform an angular movement through at least 90° about the rotation axis of the vertical portion 30*b* of the boom.

Accordingly, the rotating cutter 31 can assume an inactive position (FIG. 2), in which its rotation axis is parallel to the axis of the pipe T, and an active position (FIG. 3), in which its axis is at right angles to the axis of the pipe T.

The inactive rotated position is used to lower the rotating cutter 31 into the trench 13 or to interrupt the cutting of the wall 18 in order to form the portions that support the pipe T. In the active position, which is rotated through 90° with respect to the preceding position, the rotating cutter 31 is arranged at right angles to the pipe to remove the wall 18 and form the final bed 15 of the excavation.

Figure 3:
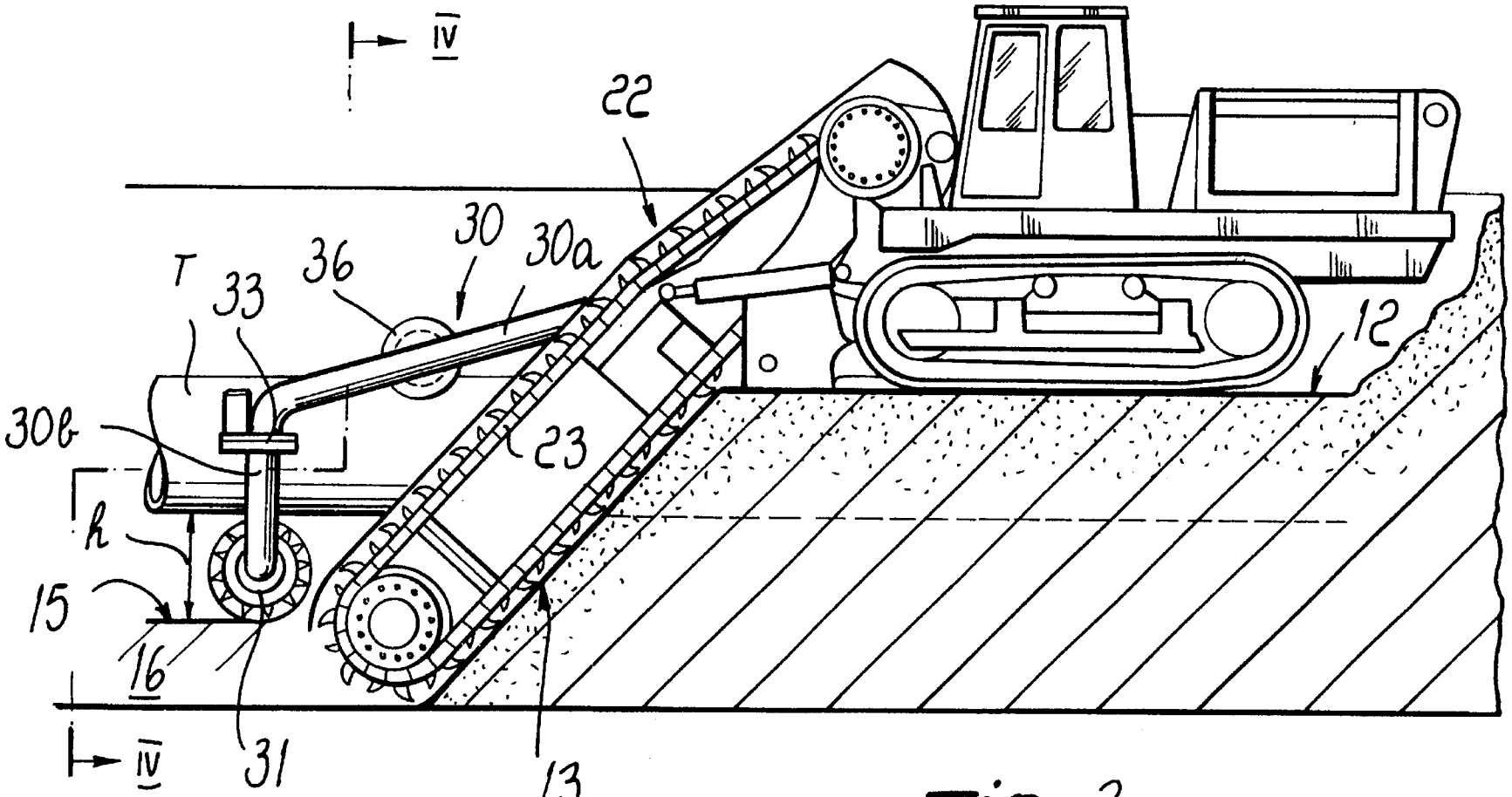
FIG. 3 is a view, similar to FIG. 2, showing the apparatus with the rotating cutter in the active position.

As clearly shown in FIGS. 3 and 4, in this active position the rotating cutter 31 is preferably tangent or substantially tangent to the lower part of the pipe at its vertical diameter, so that the diameter of the rotating cutter determines the depth of the final bed 15 and the height "h" of the gap between the lower part of the pipe and said final bed; "h" is typically between 0.7 meters and 1.2 meters.

The above described machine is provided with proximity sensors (not shown) that continuously adjust the distance between the blades of the trenchers 22 and the pipe T to avoid damage to said pipe, and is also provided with alarm and motion-halting systems that are adapted to intervene so as to halt the unit 20 if it moves beyond preset limits, in any case beyond the range of automatic adjustment of the blades of the trenchers, with respect to the centerline of the pipe T.

According to a constructive different embodiment, which is advantageous for exposing small-diameter pipes, the apparatus is formed by two self-propelled tracked units, one of which (not shown) is similar to the previously described unit 21 and is equipped only with the trencher units 22 for digging the trenches 13, whereas the other unit is provided only with the boom 30 and with the corresponding rotating cutter 31 for removing the wall 18. The second self-propelled unit, shown in FIGS. 5 and 6, follows the first self-propelled unit in the advancement sequence and can be constituted by a simple tractor which can also optionally move alongside the preliminary excavation 10.

Figure 5:
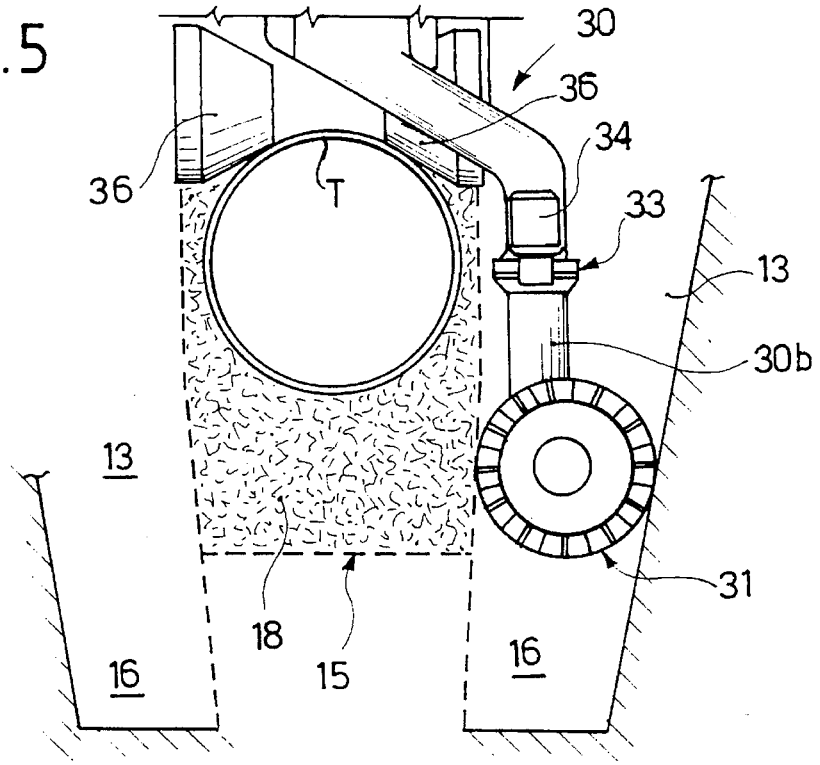
FIGS. 5 and 5*a* are sectional views, similar to FIG. 4, showing a different embodiment of the excavation apparatus with the rotating cutter in the inactive position and in the active position respectively.
Figure 5A:
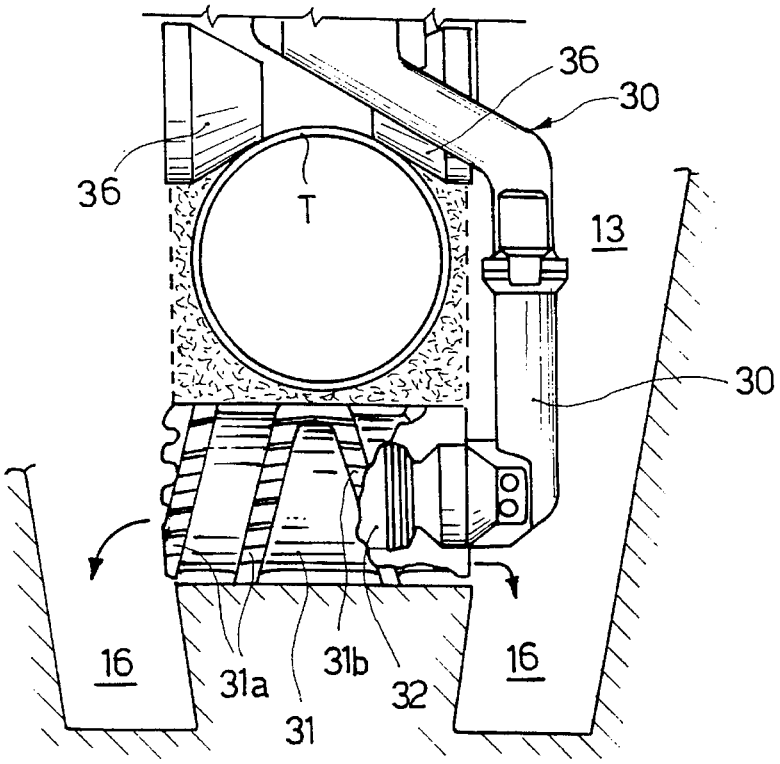

The figures show that the boom 30, which in this case runs vertically approximately 1.5 meters more than the boom of the apparatus of FIG. 2, is also supported by rollers 36 or alternatively by belts made of elastomeric material which roll in contact with the pipe T and has a rotatable end portion 30*b* that allows the rotating cutter 31 to assume the inactive position of FIG. 5 or the active position of FIG. 6.

Without altering the concept of the invention, the details of the execution of the method and the embodiments of the apparatus may of course be altered extensively with respect to what has been described and illustrated by way of non-limitative example without thereby abandoning the scope of the invention.

What is claimed is:

1. Excavation method for accessing underground pipes of pipelines for oil, gas, and the like for maintenance and/or repair, comprising the following operating steps:

forming, above a pipe, a preliminary excavation which is delimited by vertical sides and by a flat bottom such that the preliminary excavation has a depth which is substantially tangent to an upper part of said pipe;

digging, starting from the bottom of the preliminary excavation, two lateral trenches each of which being adjacent to a respective opposite side of the pipe such that said two lateral trenches mutually converge downwardly and extend deeper than a level set for a final excavation bed that lies below the pipe, so as to form respective lateral collection channels and such that said two trenches being separated, in a region below the pipe, by a continuous wall;

removing, by cutting, the continuous wall that separates the trenches in the region below the pipe;

dumping corresponding residual material of said wall into the lateral collection channels such that said lateral collection channels are filled with the residual material to a level not exceeding a level of the final excavation bed; and forming a gap having a preset height in said region below the pipe.

2. Method according to claim 1 comprising removing the wall between the two lateral trenches at interrupted regions located at preset distances with respect to an extension of the pipe in order to leave in place portions of the wall which act as supports for the pipe.

3. Method according to claim 1 comprising forming the preliminary excavation such that a width of the preliminary excavation is between two to four times the diameter of the pipe.

4. Method according to claim 1 comprising digging the two lateral trenches such that a capacity of the lateral collection channels allows said channels to contain the residual material of the wall that lies below the pipe.

5. Method according to claim 1 comprising digging the trenches and removing the wall simultaneously by means of a single self-propelled apparatus advancing along the bottom of the preliminary excavation.

6. Method according to claim 1 comprising digging the trenches and removing the wall respectively sequentially by means of respective dedicated self-propelled equipment advancing along the bottom of the preliminary excavation including a trench excavating apparatus preceding a wall removal apparatus.

7. Excavation apparatus for the maintenance and restoration of pipelines comprising:

at least one self-propelled tracked unit adapted to advance along a bottom of a preliminary excavation which extends above a pipe;

two trencher excavation units equipped with blades and being supported by said tracked unit and being driven by a hydraulic motor for digging a pair of trenches each on a respective opposite side of the pipe;

a boom supported at a rear by the tracked unit with respect to an advancement direction of the tracked unit and having a lower vertical end rotatable about a substantially vertical axis and driven by a driving element;

a double-helix rotating cutter supported by said lower vertical end of the boom and adapted to assume an active position and an inactive position that are mutually spaced by 90°; and a hydraulic motor connected to said rotating cutter for rotatably driving said rotating cutter and rigidly coupled to the lower vertical end of the boom such that a rotation axis of said hydraulic motor extends substantially horizontally;

wherein said rotation axis, in the active position of the rotating cutter, is substantially orientated at right angles to the axis of the pipe in order to remove a wall that is present below the pipe between the trenches and wherein said rotation axis is orientated, in the inactive position of the rotating cutter, substantially parallel to the axis of the pipe; and wherein in the inactive position the rotating cutter is adapted to be positioned inside a lateral trench of said pair of trenches.

8. Apparatus according to claim 7, wherein the rotating cutter has a diameter which is substantially equal to a height of an excavation gap that lies below the pipe; and wherein the rotating cutter is substantially tangent to a lower part of said pipe during the active step.

9. Apparatus according to claim 7, wherein the rotating cutter includes a left-hand helix portion and a right-hand helix portion.

10. Apparatus according to claim 7, wherein each one of said trencher excavation units comprises a belt guided by end sprockets and excavation blades associated with said belt, and wherein the trencher excavation units are orientatable in a vertical plane by means of hydraulic jacks.

11. Apparatus according to claim 7, wherein the boom comprises a fixed portion for supporting the rotating cutter, said fixed portion having supporting rollers made of elastomeric material for rolling on an upper part of the pipe; said rollers having a conical profile for transversely retaining the boom.

12. Excavation apparatus according to claim 7, comprising a first self-propelled tracked unit and a second self-propelled tracked unit, said first tracked unit supporting said two trencher excavation units, the second tracked unit supporting said boom; the second self-propelled tracked unit following the first self-propelled tracked unit an advancement direction of the units.

13. Method according to claim 3 comprising forming the preliminary excavation such that the width of the preliminary excavation is equal to approximately three times the diameter of the pipe.

* * * * *

UNITED STATES PATENT AND TRADEMARK OFFICE

CERTIFICATE OF CORRECTION

PATENT NO. : 5,601,383

DATED : February 11, 1997

INVENTOR(S) : Pierluigi, Zanin

It is certified that error appears in the above-indentified patent and that said Letters Patent is hereby corrected as shown below:

On the title page, item [73] Assignee, please add --VILLESSE (Prov. Gorizia).

Signed and Sealed this

Fifteenth Day of April, 1997

Bruce Lehman

*Attest:*

BRUCE LEHMAN

*Attesting Officer*

*Commissioner of Patents and Trademarks*